US006550894B2

(12) United States Patent
Ueno et al.

(10) Patent No.: US 6,550,894 B2
(45) Date of Patent: Apr. 22, 2003

(54) INK BOTTLE

(75) Inventors: Fumihiro Ueno, Hachioji (JP); Masao Shionoya, Iruma (JP); Nobuyuki Koyama, Hachioji (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 09/929,848

(22) Filed: Aug. 14, 2001

(65) Prior Publication Data

US 2002/0171713 A1 Nov. 21, 2002

Related U.S. Application Data

(63) Continuation-in-part of application No. 29/142,085, filed on May 16, 2001.

(51) Int. Cl.[7] ..... M41J 2/01
(52) U.S. Cl. ..... 347/49; 347/86
(58) Field of Search ..... 347/49, 85, 86, 347/87

(56) References Cited

U.S. PATENT DOCUMENTS 5,784,088 A * 7/1998 Ujita et al. ..... 347/86
5,838,354 A * 11/1998 Yamada et al. ..... 347/101
6,382,783 B1 * 5/2002 Hayashi et al. ..... 347/85

* cited by examiner

*Primary Examiner*—Anh T. N. Vo
(74) *Attorney, Agent, or Firm*—Frishauf, Holtz, Goodman & Chick, P.C.

(57) ABSTRACT

A second ink bottle is detachably attached to a bottle holder of an ink jet printer, and lower than a first ink bottle including an outflow port connected to an inflow port of the bottle holder when the ink bottle is attached to the bottle holder. The second ink bottle includes a main body having bottom and upper surfaces, in which ink is contained, a joint portion disposed on an upper portion of the main body and having an outflow port connectable to the inflow port, and a spacer detachably attached to a lower side of the main body. A height of the outflow port of the second ink bottle to a bottom surface of the spacer equals that of the outflow port of the ink bottle to a bottom surface of the first ink bottle, when the spacer is attached to the main body.

18 Claims, 13 Drawing Sheets

INK BOTTLE

CROSS-REFERENCE TO RELATED APPLICATIONS

This application is a Continuation-in-part Application of Design patent application No. 29/142,085, filed May 16, 2001.

BACKGROUND OF THE INVENTION

The present invention relates to an ink bottle for storing ink for use in image recording apparatus such as an ink jet printer, and for recharging ink when the ink bottle is attached to the recording apparatus.

An ink jet printer is known in which monochromatic ink for monochromatic recording, or multicolor ink for color recording is selectively ejected onto a recording medium (paper, film, fabric, nonwoven fabric, OHP sheet, and the like), so that an image is formed on the recording medium. This type of apparatus includes a carriage with only recording means (a recording head), or the recording means and a small ink tank mounted thereon, conveying means for conveying the recording medium, and control means for controlling the movement of these and other constituting components. In this apparatus, during recording, while conveying of the recording medium is stopped, the recording head serially scans in a direction (main scanning direction) crossing at right angles to a conveying direction of the recording medium (sub scanning direction), so that recording is made in a width direction of the recording medium. During non-recording, the recording medium is intermittently conveyed by an amount equal to a recording width for the next recording. The recording head is so constructed that, a large number of nozzles having ejection ports, arranged in at least one row in the sub scanning direction, for ejecting ink droplets are integrally constituted. When the recording head scans the recording medium once, recording is made in the width corresponding to the number of nozzles, and a high-speed recording operation can be achieved.

In the ink jet printer for the color recording, a plurality of colors of ink droplets ejected from a plurality of recording heads are overlapped, so that desired colors of dots are formed thereby forming a color image. In general, for the color recording, four recording heads for inks of black, cyan, magenta, and yellow, six recording heads additionally including light-color inks such as light cyan ink and light magenta ink, or eight recording heads further including special color inks are used. With the use of such recording heads, an apparatus in which a full-color image can be formed is brought to practical use at present.

In many of the ink jet printers constituted as described above, a large sized image is continuously recorded over a long time, and an ink consumption amount is therefore large. A large format type is known in which the recording medium having a large size such as A1 or A0 is subjected to printing. In this type of ink jet printer, the amount of ink consumed is large, and continuous recording is usually performed for extended periods of time. In this case, a large-capacity ink bottle is necessary, separated from a small ink tank mounted on the carriage in such a manner that the ink tank moves together with the recording head. The large-capacity ink bottle is detachably attached to a bottle holder which is disposed on a fixed member (immobile member) such as a printer frame. The recording head is replenished with ink in the attached ink bottle directly through a tube or via the small ink tank. When a predetermined or greater amount of ink in the ink bottle is used, the ink bottle is removed from the bottle holder, a new ink bottle filled with ink is attached to the bottle holder, and thereby the recording head can continuously be replenished with ink.

From a viewpoint of user-friendliness, it is preferable that the ink bottle having various capacities such as 250 ml, 500 ml, and 1000 ml can be used for the same recording apparatus in accordance with a user's use mode.

BRIEF SUMMARY OF THE INVENTION

An object of the present invention is to develop a technique which satisfies the aforementioned demand, and provides a suitable ink bottle.

According to one aspect of the present invention, there is provided a second ink bottle set to be lower than a first ink bottle which is detachably attached to a bottle holder of an ink jet printer and which includes an outflow port connected to an inflow port of the bottle holder when the first ink bottle is attached to the bottle holder, the second ink bottle comprising:

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
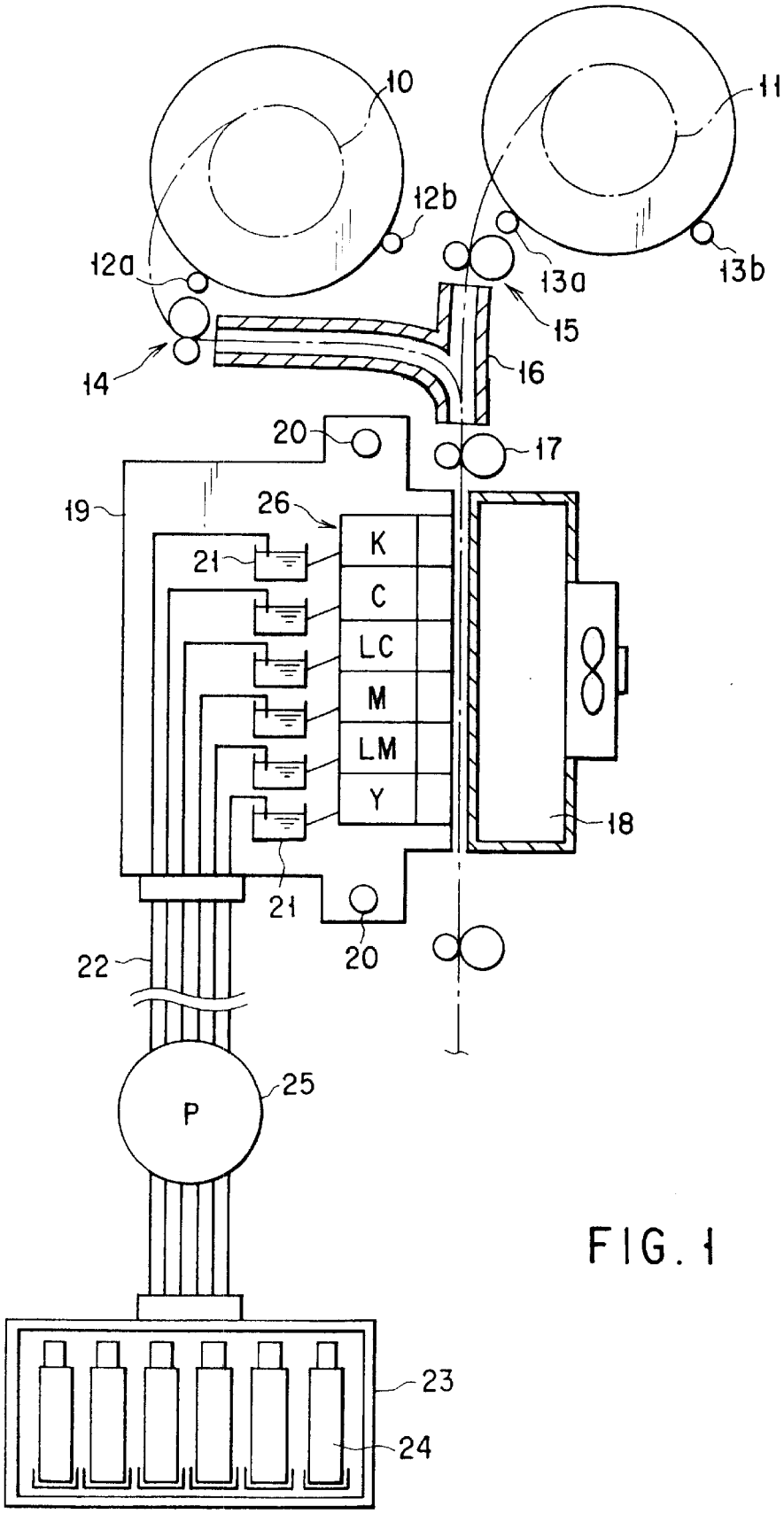
FIG. 1 is a view schematically showing one example of an ink jet printer in which an ink bottle of the present invention may be used.
Figure 2:
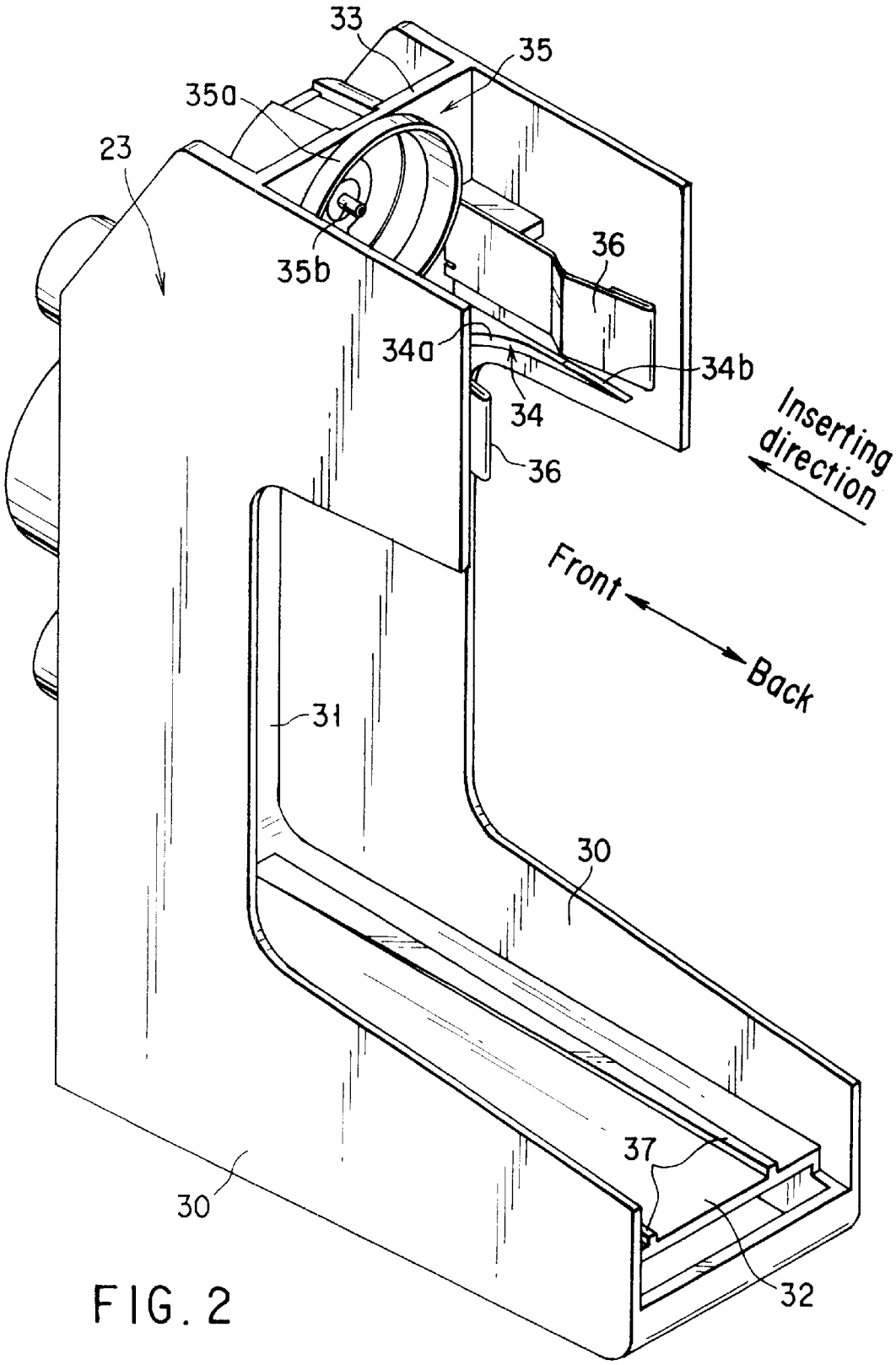
FIG. 2 is a perspective view showing a bottle holder of the printer shown in FIG. 1.

First, an ink jet printer to which an ink bottle according to the present invention is applied, and a bottle holder of the printer to which the ink bottle is detachably attached will be described with reference to FIGS. 1 and 2. In FIG. 1 showing a schematic constitution of the ink jet printer reference numerals 10 and 11 denote rolls of paper as recording mediums (shown by dashed lines). Examples of the paper may include two types of paper which have different widths and which are selectively conveyed, and the paper having the same width controlled so that when one roll of paper is used up, the other roll of paper is conveyed. Paper tube holders are attached to opposite ends of a width direction of these rolls of paper 10, 11. The respective rolls of paper are laid on respective pairs of support rollers 12*a*, 12*b*; 13*a*, 13*b* which are rotatably disposed apart from each other in a back-to-forth direction. Thus, as the roll of paper is drawn, the roll can rotate. It should be noted that a left side of FIG. 1 shows a front side of the apparatus, and a right side shows a back side.

A paper supply mechanism for guiding the paper drawn from the roll of paper to a recording section described later is disposed under the support rollers. The paper supply mechanism includes paper supply roller/nip roller pairs 14, 15 which are rotatably disposed on respective discharge sides of the rolls of paper. The paper supply roller of each pair is rotated by driving means (not shown) in at least a paper feed direction, so that the paper sheet held between the conveying roller and the nip roller is conveyed forwards. Inlets of a paper supply guide 16 are positioned on outlet sides of the paper supply roller/nip roller pairs 14, 15. The paper supply guide is constituted of a horizontal guide section for horizontally guiding the first paper sheet 10, and a vertical guide section for vertically guiding the second paper sheet 11. A conveying roller/nip roller pair 17 is rotatably disposed on a conveying side in the vicinity of an intersection of these guide sections. The conveying roller is rotated by the driving means (not shown) in synchronization with one of the paper supply roller/nip roller pairs 14, 15, so that the paper held between this conveying roller and the nip roller is conveyed to the recording section.

The recording section is formed by a platen 18 and a carriage 19, and makes accomplishes recording onto the paper sheet conveyed between these components. The platen 18 is fixed in the apparatus, and includes a back-side vertical wall with a plurality of holes formed therein for sucking and holding the paper sheet, and means for setting a negative pressure in the platen. The carriage 19 is disposed to be linearly movable along a guide 20 in a direction crossing at right angles to the conveying direction of the paper, that is, a main scanning direction, and is reciprocated by a driving mechanism (not shown). The carriage 19 contains an assembly 26 of six recording heads, that is, ink jet heads which have a large number of nozzles for ejecting black (K), cyan (C), light cyan (LC), magenta (M), light magenta (LM), yellow (Y) inks, respectively, to realize color recording, and which are successively mounted along the conveying direction of the paper sheet, that is, the sub scanning direction as schematically shown by blocks. Six small-sized, that is, small-capacity ink tanks 21 which store the respective inks and can supply the inks to the corresponding heads via tubes are disposed in the vicinity of the corresponding recording heads and fixed to the carriage 19. The sub containers 21 are connected to respective ink supply sections of a bottle holder 23 described later in detail via tubes 22. When ink in the sub container 21 has a predetermined or less level, the container is replenished with ink by an assembly 25 of respective pumps from each of six large-capacity ink bottles 24 attached to the bottle holder 23.

Next, an operation of the recording apparatus constituted as described above will briefly be described.

A tip end of the paper sheet from the paper roller 10 or 11 is held in the corresponding paper supply roller/nip roller pair 14 or 15, the paper supply roller is driven, and the paper sheet is guided to the conveying roller/nip roller pair 17 via the paper supply guide 16. When the paper supply roller is driven, the conveying roller is also driven, the tip end of the conveyed paper sheet is held, and the paper sheet is conveyed to the recording section. When the tip end of the paper sheet reaches a predetermined position and, for example, when the paper sheet passes through the recording section, this is sensed by a sensor (not shown), the driving means is stopped, and thus the conveying of the paper sheet is stopped. As a result, the paper sheet is sucked/held by a back wall of the platen 18. When the carriage 19 linearly moves in the main scanning direction in this state, ink is ejected from the recording head, and the recording is made. In color recording, first, the carriage moves in one direction, only the recording head (K) of black ink is driven, and ink is ejected onto the paper sheet. When the recording is completed, the driving means is slightly driven to convey the paper sheet forwards by a recording width of the head K, and is then stopped. When the carriage 19 is moved in another direction in this state, recording of black ink by the head K and recording of cyan ink by the head C are performed. In this case, it would be understood that a recorded area of cyan ink is the same as a first recorded area of black ink. Similarly, when the paper sheet is temporarily conveyed, the carriage is linearly moved, and the recording head is selectively driven, the recordings in light cyan, magenta, light magenta, and yellow ink are successively performed, and finally a color image with six colors overlapped thereon is recorded on the paper. This recording apparatus is disclosed, for example, in U.S. Pat. Nos. 5,838,354 and 6,042,228, the contents of which are incorporated herein by reference.

The bottle holder 23 will next be described in detail with reference to FIG. 2. Six bottle holders for the corresponding six ink bottles 24 are disposed side by side and fixed to the recording apparatus. Since these holders have substantially the same constitution, only one holder is shown in FIG. 2.

The bottle holder 23 has two side plates 30 which are disposed in parallel to each other via a constant interval, vertically disposed/fixed, and are substantially L-shaped. The bottle holder also has a front plate 31 which is disposed between the side plates on a front side, positioned crossing at right angles to the side plates, and defines a front position in an inserting direction of the ink bottle. A bottom plate 32 is connected to lower ends of the side plates 30 so that the bottom plate crosses at right angles to the side plates. The side plates 30 are connected to each other by a joint support plate 33 positioned in a front upper portion of the holder. Between the side plates 30, a bottle support plate, that is, a flange guide 34 is disposed above the bottom plate 32, and projects downwards from the joint support plate in parallel to the bottom plate 32. A holder-side joint portion 35 is disposed on a back surface (inner surface) of the joint support plate 33. Respective leaf springs 36 are attached to upper inner surface portions of the opposite side plates 30 and positioned behind the joint portion 35.

Since the interval between the side plates 30 is set to be slightly broader than the width of an ink bottle, the ink bottle is easily inserted, and the inserted ink bottle is prevented from rattling sideways. A pair of bottom guides 37 project from the upper surface of the bottom plate 32, are disposed apart from each other via a predetermined interval, and extend back to forth, that is, in the bottle inserting direction. These bottom guides function as second guide members for easily guiding a heavy ink bottle inserted between the side plates. The flange guide 34 is formed on a front end surface of the joint support plate 33, and includes a cutout 34*a* having a U-shaped end surface. The width of the cutout 34*a* is set to be slightly larger than an outer diameter of a neck portion narrowed between the joint portion of the ink bottle and the bottle main body, and holds the neck portion of the inserted ink bottle so that the portion does not move in a lateral direction. A taper portion 34*b* descending backwards is formed on the back end surface of the flange guide. A height of the back end of the taper surface is set to a position slightly lower than a lower surface of a flange formed on the lower end of the joint portion of the ink bottle guided along the bottom guide 37. A flat upper surface of the flange guide 34 is slightly higher than the lower surface of the flange. As a result, the ink bottle guided and inserted along the bottom guide 37 is guided while the lower surface of the flange of the joint portion rides on the upper portion of the taper surface of the flange guide 34. When the ink bottle is further inserted forwards and finally laid on the flat upper surface of the flange guide, the bottom surface of the ink bottle is slightly raised above the bottom guides, and the joint portion of the ink bottle is connected to the joint portion 35 on the holder side. That is, the flange guide 34 serves as a first guide member for positioning the joint portion of the ink bottle in a vertical direction with respect to the joint portion 35 on the holder side.

The two leaf springs 36 having the same shape are disposed opposite to each other, and extend along the inner surfaces of the side plates 30 in the inserting direction. A substantially center portion of the inserting direction of each leaf spring is bent to project inwards, and defines a constriction between the center portions of opposite leaf springs. The width of the constriction, that is, a distance between the leaf springs is set to be slightly narrower than an outer diameter, that is, a maximum width of the joint portion of the ink bottle. As a result, when the ink bottle is inserted in the inserting direction as shown by an arrow, an outer surface of the joint portion depresses the projecting center portion of the leaf spring. After the maximum width portion of the joint portion passes through the projecting center portion, the projecting center portion elastically presses a back side of the joint portion of the ink bottle forwards, and is elastically restored. As a result, the joint portion of the ink bottle is finally securely connected to the joint portion of the holder, and the ink bottle is prevented from shifting in a direction opposite to the inserting direction in the holder by an elastic force of the leaf spring 36.

The joint portion 35 on the holder side is constituted of: a second annular connector 35*a* projecting from the inner surface of the joint support plate 33, and to be engaged with a first annular connector 58 projecting from a tip end of the ink bottle on an insertion side as described later; an insertion pin 35*b* projecting from the joint support plate coaxially with a center axis of the second annular connector 35*a* in a vertical direction with respect to the joint support plate, and defining the inflow port; and a press surface 35*c* (shown in FIG. 4A) formed slightly inside a tip end of the insertion pin 35*b* along the bottle inserting direction, for pressing an air intake of the ink bottle described later. In the first annular connector 58 of the ink bottle, a taper portion is formed such that an outer diameter of the connector is reduced toward an outer peripheral tip end of the connector. When this taper portion slides on an inner peripheral surface of the second annular connector 35*a* of the holder, and the first annular connector is overlapped with and inserted into the second annular connector 35*a*, both the joint portions are positioned with each other. While the joint portions are connected to each other, the ink bottle is attached to the holder. In this state, the insertion pin 35*b* is inserted into an insertion port of the ink bottle, that is, the inflow port. The ink bottle and bottle holder are communicated to each other, so that ink can be supplied to the recording apparatus from the ink bottle. In this state, the atmospheric open valve disposed inside the first annular connector of the ink bottle is depressed into the joint portion of the ink bottle by the press surface 35*c*, so that the inside of the ink bottle is connected to the atmosphere. The insertion port and atmospheric open valve of the ink bottle will be described later in detail.

A bottle of standard type having a capacity of 500 ml will next be described as one example of a first ink bottle with reference to FIGS. 3A to 3D.

An ink bottle 50 includes: a bottle main body 51 for containing and storing ink; a joint portion 52 to be connected to the joint portion 35 of the holder (FIG. 2) so that ink in the bottle main body can be supplied to the joint portion 35; and a cap 53 (FIG. 3D), optionally added and attached to the bottle main body 51, for covering the joint portion 52 until the ink bottle is attached to the holder. The bottle main body 51 has an outer shape of a substantially square tube narrowed in the width direction, or a flat box shape, and has a hollow inner part. Moreover, a bottom surface of the bottle main body is substantially flat. Concave portions are formed on opposite sides of one end of a longitudinal direction (end of the direction opposite to the inserting direction) of the bottle main body 51, to form a grip portion 54 easily gripped by a user at their end portions. An upper end of the bottle main body 51 is closed by an upper wall 55 which has an opening substantially in a middle. A connection cylinder 55*a* having a male screw vertically projects from the upper wall 55 to surround the opening. A lower portion of the connection cylinder 55*a* has a slightly large diameter via a shoulder.

The joint portion 52 to be connected to the joint portion of the holder is mounted on the upper wall 55 of the bottle main body 51. The joint portion 52 has a joint main body 56 from which a connected cylinder 56*a* having a female screw engaging with the connection cylinder 55*a* projects downwards. An outer flange 56*b* is formed on a lower end of the connected cylinder 56*a*. By abutting the connected cylinder 56*a* onto the shoulder of the connection cylinder 55*a*, the portion of the joint portion 52 is determined in the vertical direction. A portion of the connection cylinder 55*a* between the flange 56*b* and the upper wall 55 of the bottle main body 51 is defined as a neck. The first annular connector 58 to be inserted into the second annular connector 35*a* of the holder as described above is formed integrally on a tip end surface of the joint main body 56. A plurality of ribs having tapered tip end surfaces project from an outer periphery of the annular connector 58 at predetermined intervals in a peripheral direction. These ribs mechanically strengthen the annular connector, and define an engagement surface with the tubular connector 35*a* of the holder. A channel 57 is formed in the joint main body 56, and bent toward the annular connector 58 so as to extend coaxially with the connected cylinder 56*a* and annular connector 58. The channel 57 has an inflow port in the connection cylinder 55*a*, and an outflow port in the end surface of the joint main body 56 which corresponds to the center of the annular connector 58. The outflow port constitutes an insertion port 59 into which the insertion pin 35*b* of the bottle holder is inserted as described above. A ball 61 biased in an open end direction by a compression coil spring 60 is inserted in the insertion port to close the channel 57. An escape groove is formed in the channel in the vicinity of the ball 61. When the insertion pin 35*b* is inserted into the insertion port 59 to press the ball 61 against a biasing force of the coil spring 60, by a tip end of the insertion pin 35*b* the ball moves backwards and enters the escape groove, so that the closed channel is opened. For exchanging the ink bottle, when the insertion pin 59*b* is relatively removed from the insertion port 59, the ball 61 returns to its original position by the coil spring 60, and the channel is again closed. The channel 57 is automatically opened/closed by attaching/detaching the ink bottle with respect to the holder in this manner. An upper end of a tube 62 whose lower end is inserted into ink in the bottle main body 51 is connected to an inflow side of the channel 57. As a result, when the joint portion 52 of the ink bottle is connected to the joint portion 35 of the holder as described above, and the channel 57 is opened, ink in the bottle main body 51 is ejected via the insertion port 59 via the tube 62 and channel 57, fed into the insertion pin 35*b* of the recording apparatus, and supplied to the recording head.

An breather channel is formed under the channel in the joint main body 56, and connected to the inner space of the ink bottle so as to extend in parallel to the channel 57 which extends coaxially with the annular connector. An atmosphere-side opening of the breather channel is formed in the end surface of the joint main body 56. An air intake (tapered pin) biased in an open end direction by the compression coil spring is disposed in the breather channel. When a large diameter of the tapered portion contacts the inner wall of the breather channel (strictly speaking, O-ring), the breather channel is closed.

Figure 3A:
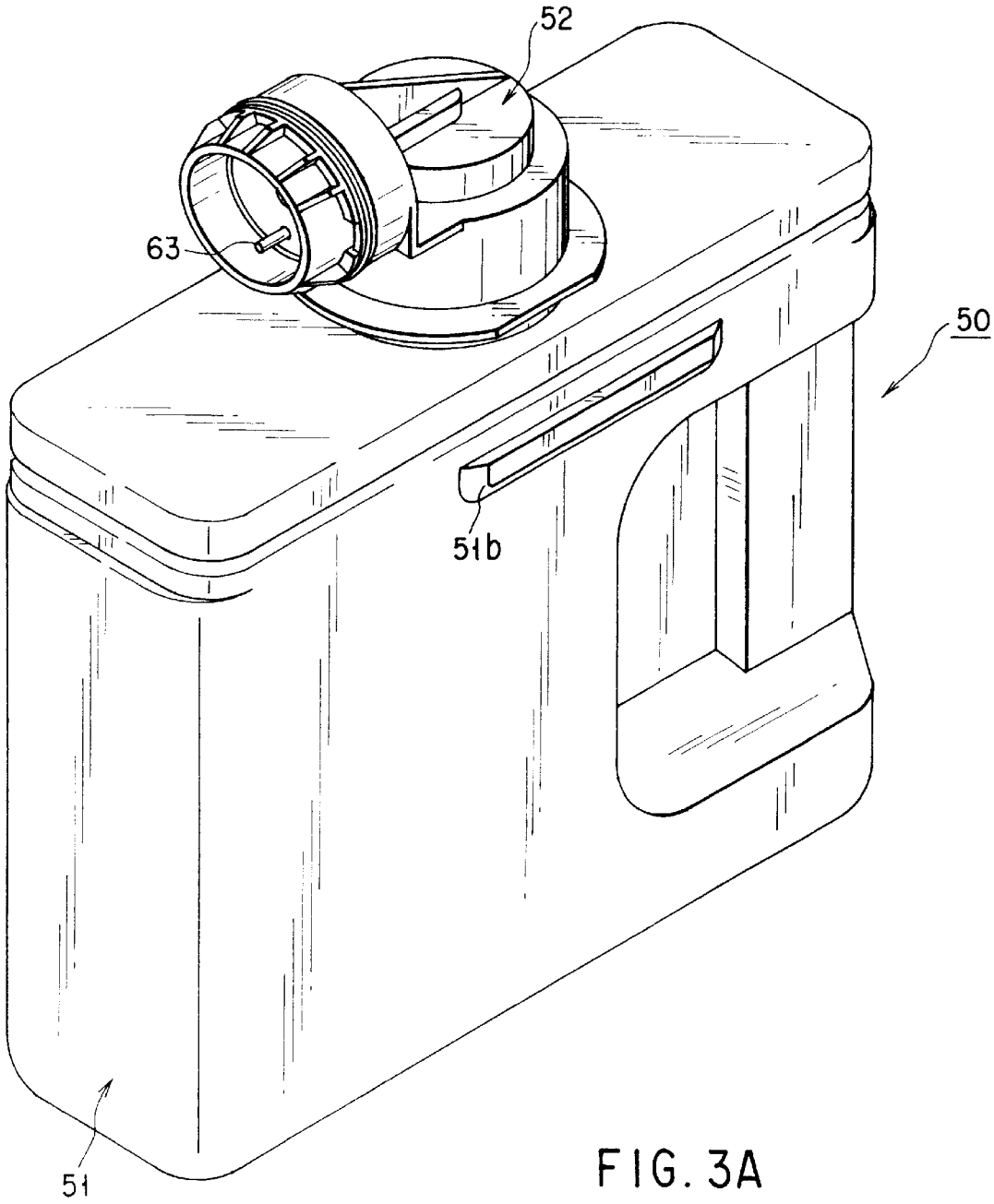
FIGS. 3A to 3C are a perspective view, side view, and sectional view of an ink bottle of a first type (standard type).
Figure 3B:
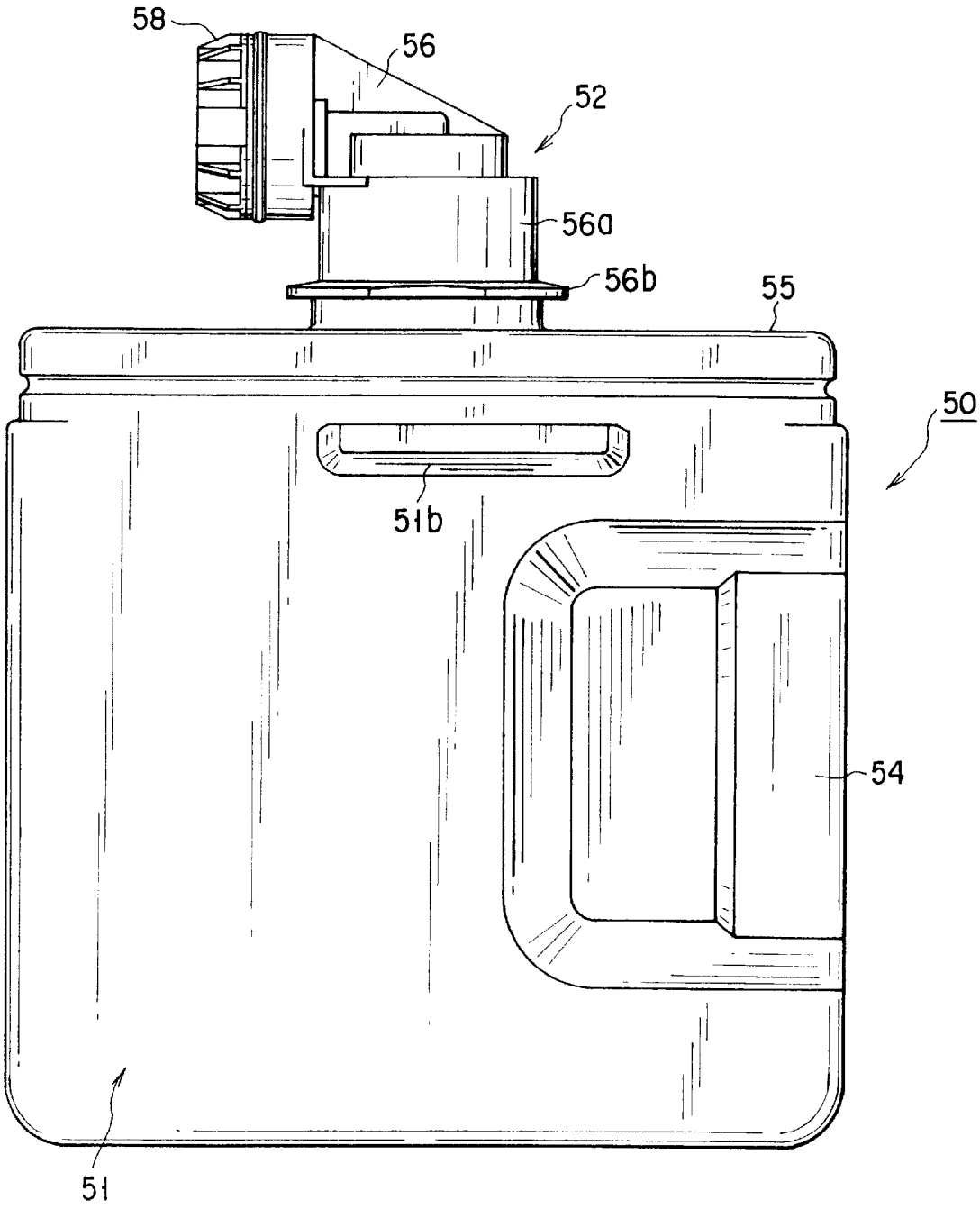
Figure 3C:
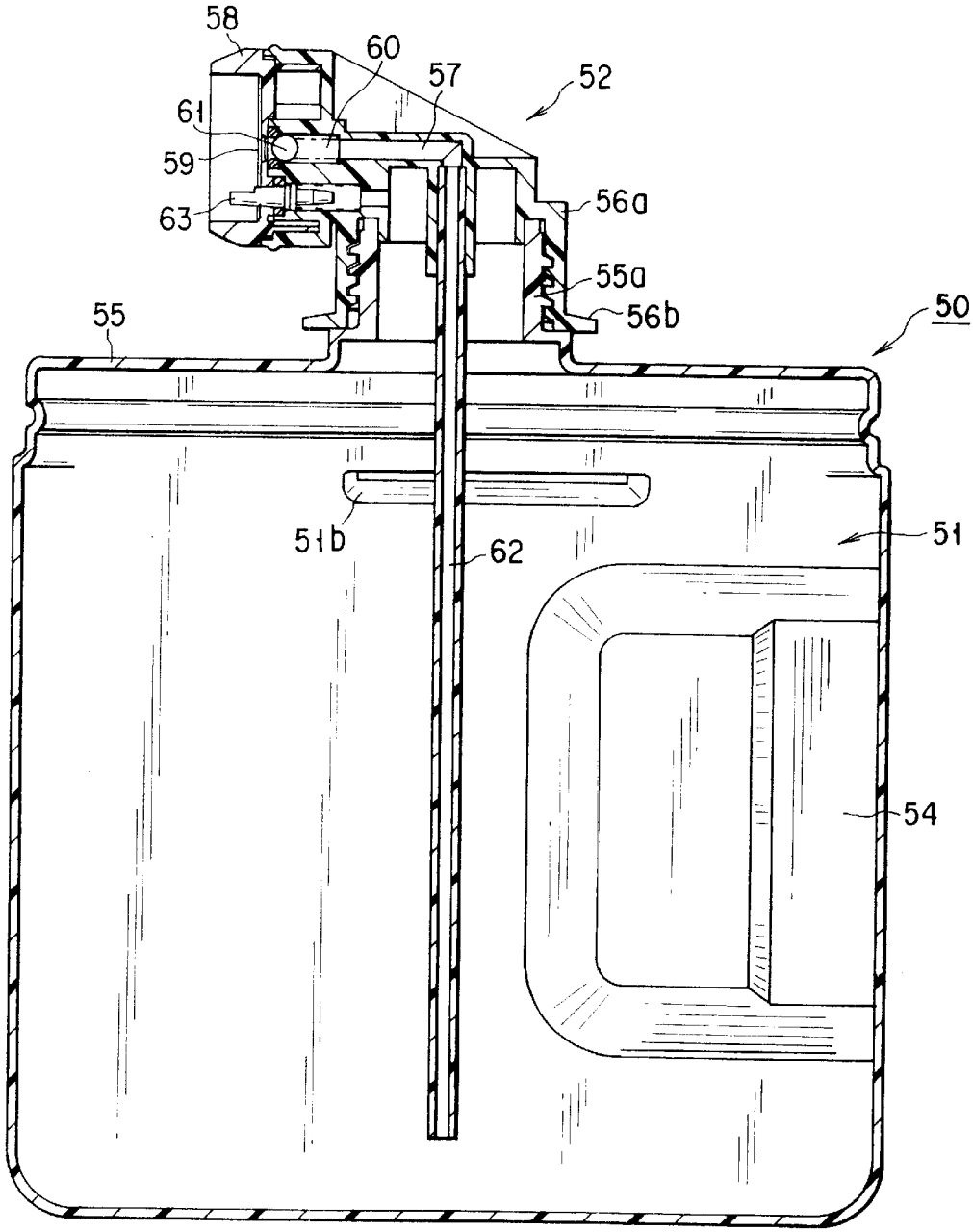
Figure 3D:
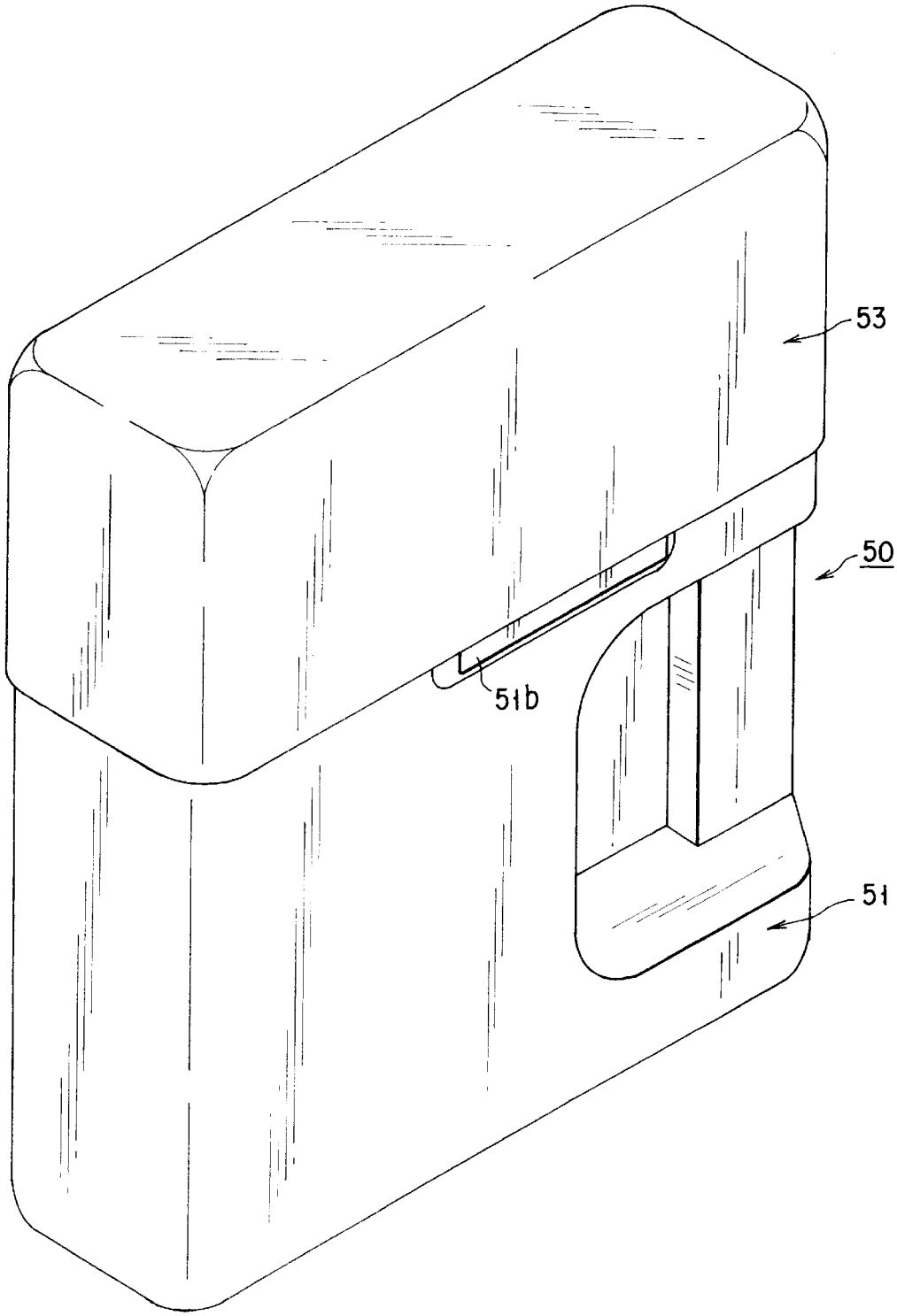
FIG. 3D is a perspective view showing that a cap is attached to the standard type ink bottle.

In FIGS. 3A to 3D, reference numeral 51*b* denotes an engagement protrusion integrally formed on an outer surface of each side wall of the bottle main body 51. When the cap 53 covers the bottle main body 51 in order to protect the joint portion 52 as shown in FIG. 3D, the upper end surfaces of the engagement protrusions abut on the lower end surface of the cap 53, and prevent the cap from further shifting downwards.

When the ink bottle is attached to the bottle holder, and the annular connectors engage with each other, the atmospheric open valve is depressed by the press surface 35*c* of the bottle holder, and pushed into the breather channel against the bias force of the compression coil spring. Then, a large-diameter portion of the atmospheric open valve having closed the breather channel moves inwards in the breather channel, and the closed breather channel is opened. As a result, since the inside of the ink bottle is communicated to the atmosphere, ink in the ink bottle can easily be supplied to the recording head.

Moreover, when the ink bottle is exchanged, the press surface 35*c* is apart from the atmospheric open valve. Therefore, the atmospheric open valve returns to its original position, so that the breather channel is again closed.

An operation for exchanging the ink bottles with respect to the bottle holder will hereinafter be described in more detail.

Figure 4A:
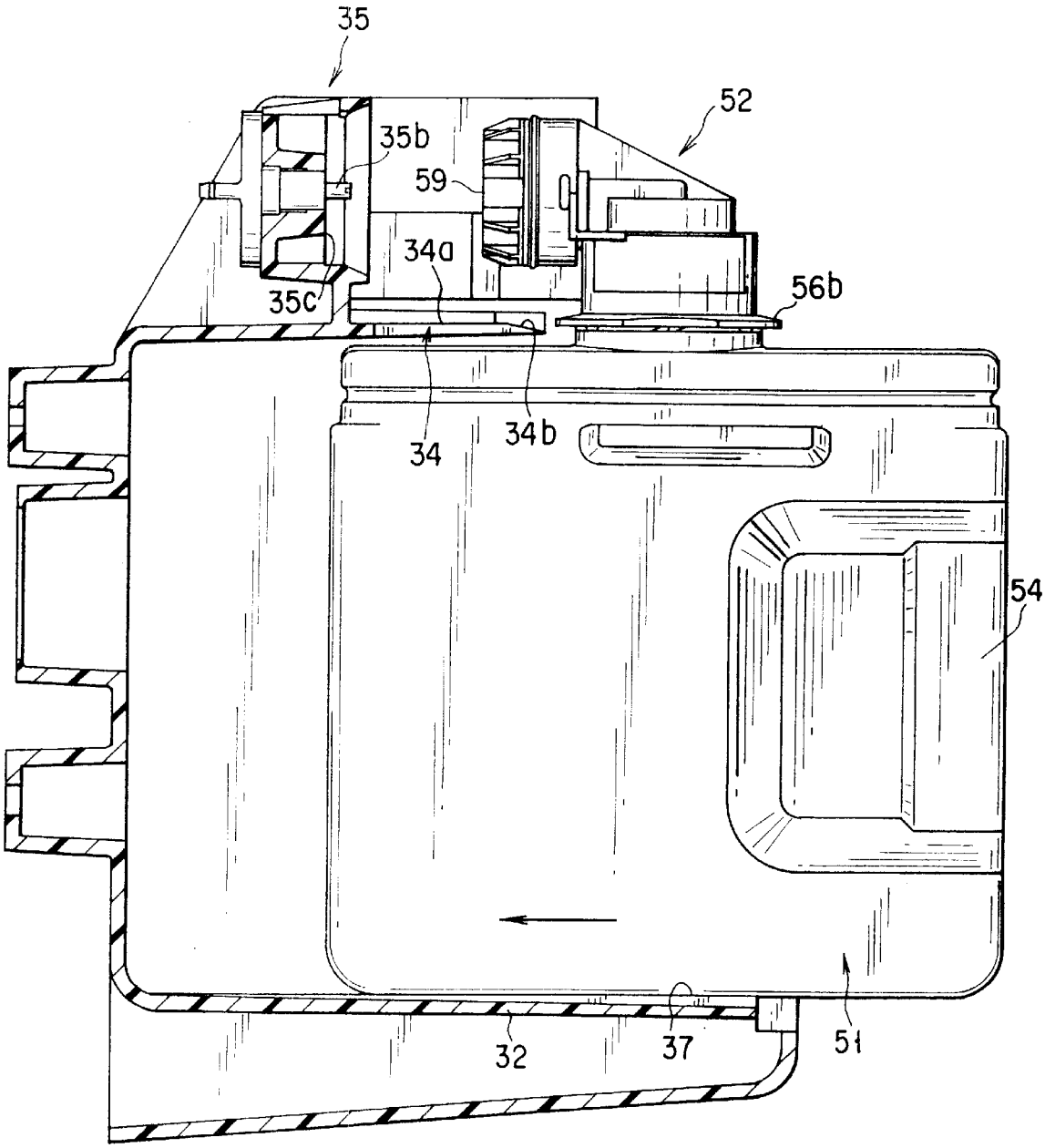
FIGS. 4A and 4B are diagrams showing different operations for attaching the standard type ink bottle to the holder of the ink jet printer.
Figure 4B:
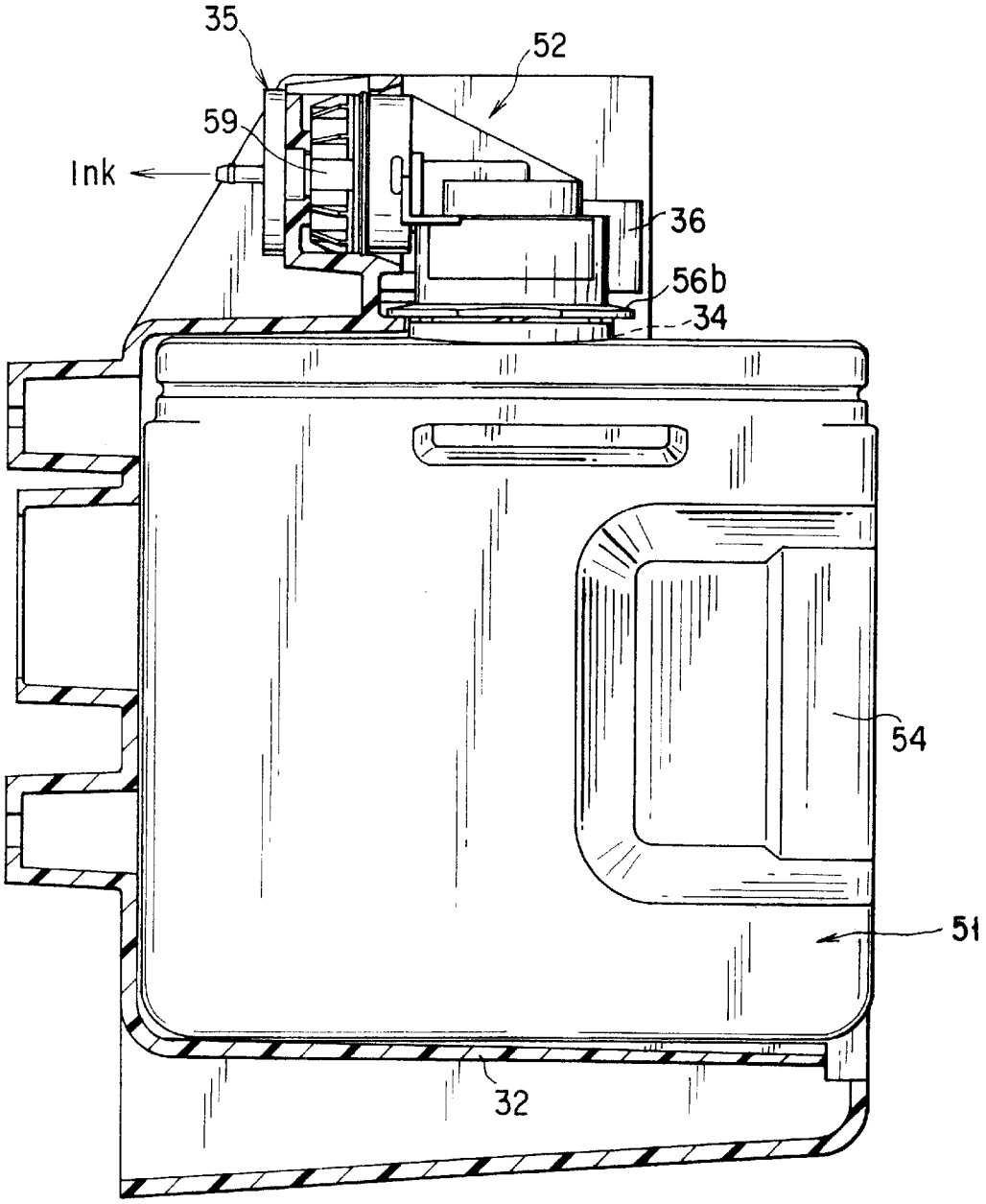

When ink residual amount of any ink bottle attached to the bottle holder is a predetermined or less amount, a sensor (not shown) senses this and notifies to a user. The user grasps the grip portion, and extracts the ink bottle from the bottle holder in the direction opposite to the inserting direction. Subsequently, the cap 53 of a new ink bottle prepared beforehand is removed from the bottle main body 51, so that the joint portion 52 is exposed. While the bottom surface of the ink bottle is laid on the bottom guides 37 of the bottle holder, the ink bottle is pushed into the bottle holder. As a result, as shown in FIG. 4A, one end of the flange 56*b* of the joint portion 52 is disposed opposite to the taper surface 34*b* formed on the projecting end of the flange guide 34. When the ink bottle is further pushed inwards, the lower end surface of the flange 56*b* abuts on the taper surface 34*b* and slides on the taper surface. In this case, the bottom surface of the bottle floats above the bottom guides 37 in accordance with an angle of the taper surface, and the flange guide 34 finally rides on a flat surface. Furthermore, the joint portion 52 of the ink bottle slides on the flange guide in the inserting direction, and is finally connected to the joint portion 35 of the holder as shown in FIG. 4B. Such a relation between the flange 56*b* and the flange guide 34 constituted as described above facilitates and secures the positioning of the joint portions to each other in a vertical direction. Additionally, when the joint portion 52 is supported by the flange guide 34, and the ink bottle is guided in this state, the bottom surface of the ink bottle is apart from the bottom guide 37. Therefore, the ink bottle may slightly rotate clockwise or counterclockwise along the surface of FIG. 4A, but a corner of the bottom surface of the ink bottle abuts on the bottom guides 37 during rotation, and the ink bottle is therefore inhibited from rotating more than necessary. Therefore, the joint portions are prevented from being mis-aligned with each other because of the rotation. The bottom guides 37 prevent the ink bottle from rotating more than necessary, from when the ink bottle is supported by the flat portions of the flange guides 34 until the bottle-side joint portion 52 is connected to the holder-side joint portion 35. Here, "rotating more than necessary" means rotation causing a deviation between a center axis of the pin 35*b* and a center axis of the outflow port of the channel 57 to such an extent that the insertion pin 35*b* of the holder-side joint portion cannot be inserted into the insertion port 59 of the bottle-side joint portion. While the flange 56*b* of the ink bottle is guided on the flange guide 34, the neck of the ink bottle enters the U-shaped cutout 34*a* of the flange guide 34, and moves forwards along the cutout. This technique facilitates and secures the positioning of the joint portions to each other in a left to right direction. While the flange 56*b* of the ink bottle is guided on the flange guide 34, the maximum width portion of the bottle-side joint portion 52 elastically deforms the constriction defined between the center protrusions of two leaf springs 36, and is passed through the constriction and inserted into the holder. After the maximum width portion of the joint portion 52 passes through the constriction, the center protrusion of the leaf spring elastically biases the joint portion 52 of the ink bottle toward the joint portion 35 of the holder. As a result, connection of the opposite joint portions 35, 52 is set to be firmer by elastic support. This state is shown in FIG. 4B.

Any person skilled in the art would understand that the aforementioned constitutions and combination of the holder-side joint portion and bottle-side joint portion facilitate attachment/detachment of the ink bottle with respect to the bottle holder, and realize a satisfactory connection, and that the connection is achieved without any problem even with a slight manufacturing error of the ink bottle.

Figure 5B:
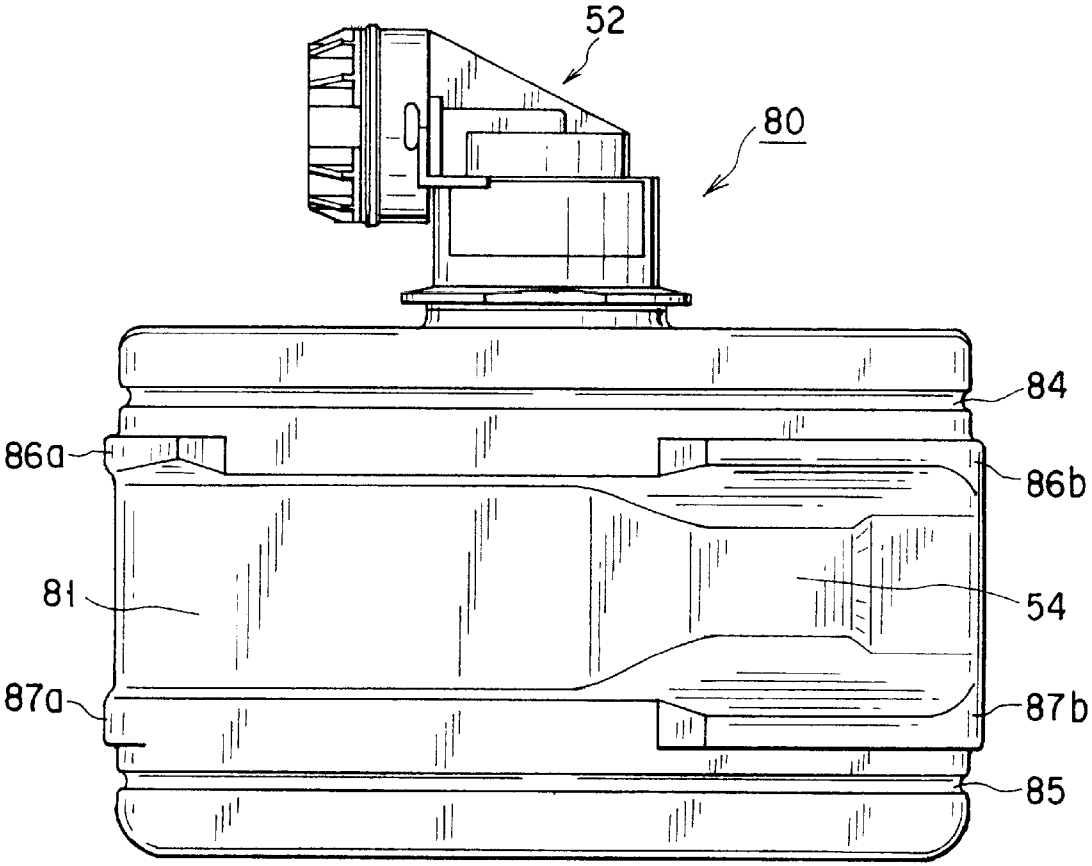
FIGS. 5A to 5C are a front view and side view of an ink bottle of a second type (having a capacity smaller than that of the standard type of ink bottle), lower than the first type ink bottle, in which the cap is removed and a sectional view in which the cap is attached.
Figure 5A:
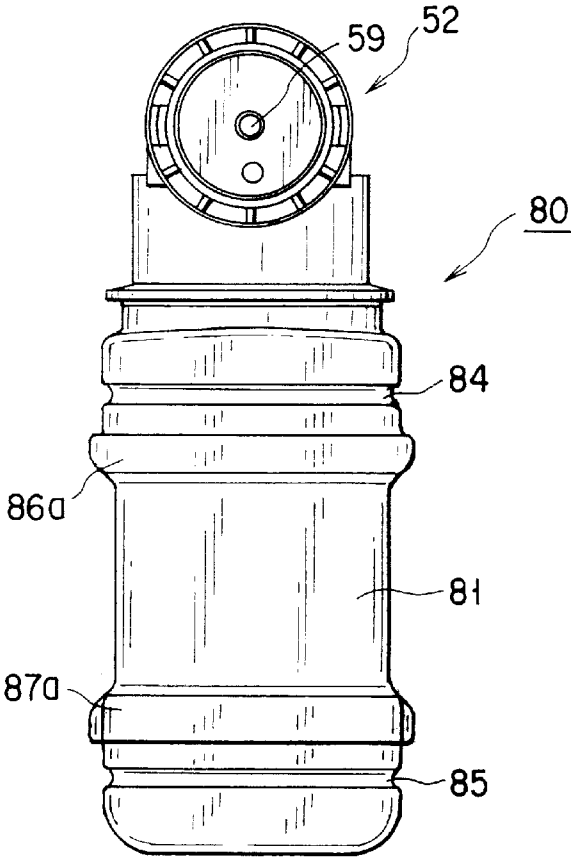

One example of a second ink bottle will next be described in detail with reference to FIGS. 5A to 5C. The second bottle has a capacity of 250 ml which is half of the capacity of the standard type of bottle. Substantially the same members of the second bottle as those of the first bottle having a capacity of 500 ml are denoted with the same reference numerals, and description thereof is omitted.

An ink bottle 80 includes: a bottle main body 81 for containing and storing ink; the joint portion 52 to be connected to the joint portion 35 of the holder (FIG. 2) so that ink in the bottle main body is supplied to the joint portion 35; and a cap 83 (FIG. 5C), attached to the bottle main body 81, for covering the joint portion 52 until the ink bottle is attached to the holder.

The bottle main body 81 has the same width and length, but has about half the height and half the capacity of the 500 ml bottle.

In the present embodiment, the joint portion 52 has the same position and constitution with respect to the bottle main body as those of the joint portion of the standard type ink bottle. However, the joint portion does not have to be necessarily the same as the standard type joint portion, as long as the joint portion is positioned and constituted so as to be satisfactorily connected to the holder-side joint portion connectable to the standard type ink bottle.

The bottle main body 81 has two engagement grooves 84, 85 which are respectively formed in the vicinity of upper and lower surfaces of the main body and which horizontally extend over a whole periphery of the main body. The upper and lower engagement grooves 84, 85 have substantially rectangular sections, but the sections are not limited and may be semicircular or of any other shape. Moreover, the grooves are formed over the whole periphery of the bottle main body, but may be formed in a part of the peripheral surface of the bottle main body such as only opposite side surfaces and only opposite end surfaces. Upper stoppers 86*a*, 86*b* and lower stoppers 87*a*, 87*b* project from the peripheral surface of the bottle main body so that the stoppers are positioned right under the upper engagement groove 84 and right above the lower engagement groove 85. The upper end surface of the upper stopper is horizontal and flat, and defines a first abutment surface. The lower end surface of the lower stopper is horizontal and flat, and defines a second abutment surface. In the present embodiment, the front stoppers 86*a*, 87*a* extend to the side surface from the front end surface, and the back stoppers 86*b*, 87*b* extend to the side surface from the back end surface, but the present embodiment is not limited to such arrangement. For example, the stoppers may extend over the outer peripheral surface of the bottle main body or may be disposed only on the opposite side surfaces or the opposite end surfaces.

Figure 5C:
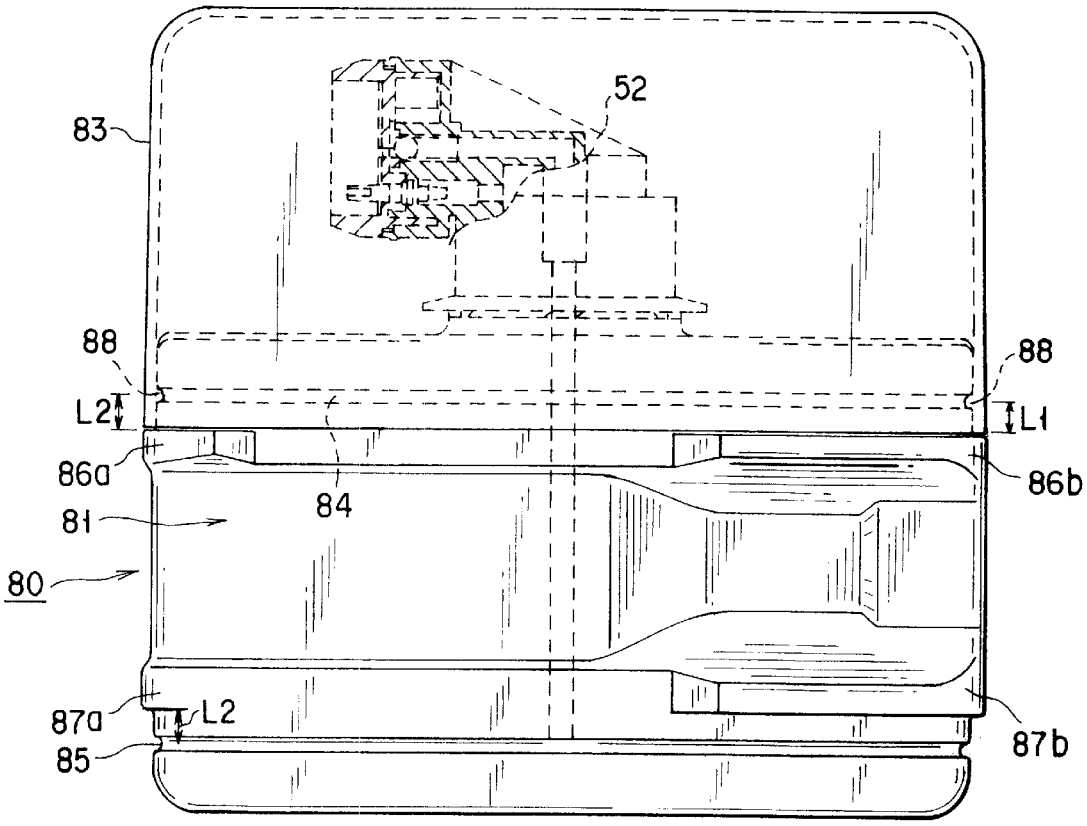

As shown in FIG. 5C, the cap 83 has a substantially rectangular box shape whose one end (lower end in FIG. 5C) is open and whose upper end is closed by the upper wall, and has substantially the same width and length as the bottle main body. The height of the cap will be described later in detail. A plurality of engagement protrusions or detents 88 project from the vicinity of the lower end of the cap 83 or extend in parallel to the lower end. The engagement protrusions have substantially rectangular sectional shapes, and are dimensioned so as to be inserted or fit into the engagement grooves 84, 85 of the bottle main body. In the embodiment, one engagement protrusion is formed on each inner peripheral end surface of the cap, and two engagement protrusions are formed on each side surface. However, this is not limited, and the engagement protrusion may be formed over the whole inner peripheral surface. A distance L1 between the engagement protrusion 88 and the lower end surface of the cap is set to be equal to or slightly shorter than a distance L2 between the upper engagement groove 84 of the bottle main body 81 and the abutment surface of the upper stopper 86*a* or 86*b* and the distance L2 between the lower engagement groove 85 and the abutment surface of the lower stopper 87*a* or 87*b*. In the former case, the cap is more firmly fixed to the bottle main body by the engagement of the engagement protrusion 88 and engagement groove 84. In the latter case, when the engagement is not secured, the cap is fixed to the bottle main body.

The cap constituted as described above is not necessarily limited, but the constitution and dimensions of the cap are the same as those of the cap (denoted with the reference numeral 53 in FIG. 3C) of the standard ink bottle. That is, this aspect has not been described for the standard ink bottle, but similarly as the cap 83, the plurality of engagement protrusions or detents also project from the vicinity of the lower end of the cap 53 and extend in parallel to the lower end. When the engagement protrusion is fitted into the engagement groove formed in the bottle main body, the cap can be attached to the standard type of ink bottle.

An operation of attaching the cap 83 to the bottle main body 81 of the second type ink bottle will next be described. It should be understood that the attaching operation is the same as that of the first type ink bottle.

The cap is attached to the bottle main body 81 in order to protect the joint portion 52 of the ink bottle. During attachment, the cap is vertically moved downwards along the bottle main body from above until the engagement protrusion 88 is inserted or fitted into the upper engagement groove 84 of the bottle main body. When the protrusion engages with the groove, the cap is stopped from moving downwards. This state is shown in FIG. 5C. For this, a distance between the inner surface of the upper wall of the cap and the engagement protrusion is set such that the inner surface does not abut on the joint portion 52. When the cap is disposed, the joint portion 52 is prevented from being broken or deformed by an external force applied to the portion during storage or transport of the ink bottle. If breakage or deformation occurs, the joint portions are not securely connected to each other during attachment of the ink bottle to the holder of the recording apparatus, and an ink leak or recharging defect occurs.

Ink bottles of both types (standard type of 500 ml type, and 250 ml type) may be formed of any material that does not adversely affect the contained ink. Examples of the material include an inexpensive synthetic resin able to be injection-molded and having transparency such that the color of ink inside the bottle can be recognized. Particularly, polyethylene terephthalate (PET resin), polyethylene naphthalate (PEN resin), polyacrylonitrile (PAN resin), and polyethylene (PE resin) are preferable.

Polypropylene (PP resin) is preferable as the material of the cap in view of low cost, moldability, and resistance to shock. However, this material is not limited, and other materials may also be used such as polyacetal (POM resin), polycarbonate (PC resin), polyethylene (PE resin), and ABS resin.

Figure 6:
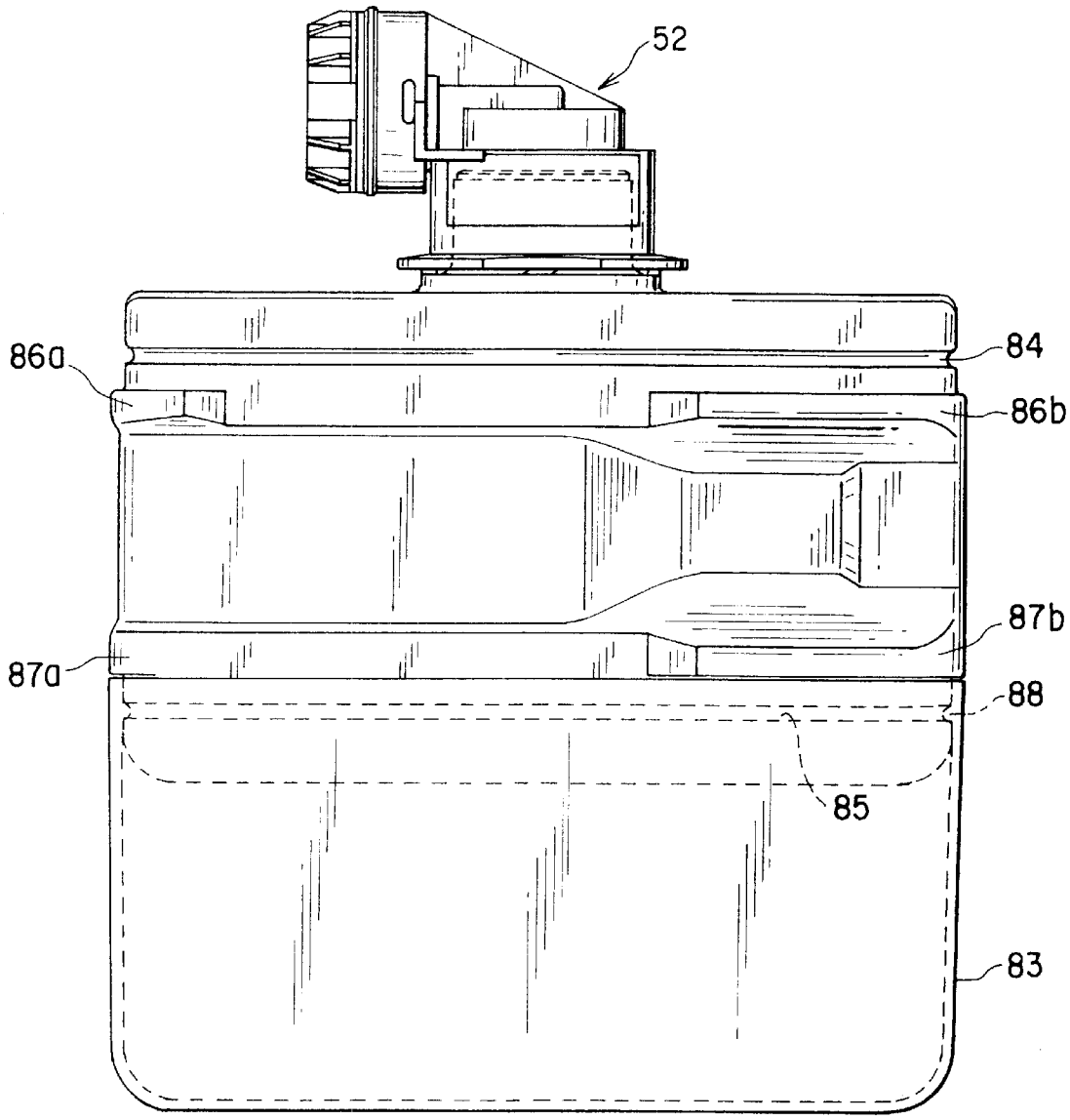
FIG. 6 is a side view of an assembly of a bottle main body and the cap in a state in which the cap shown in FIG. 5C is attached to a lower side of the bottle main body.
Figure 7:
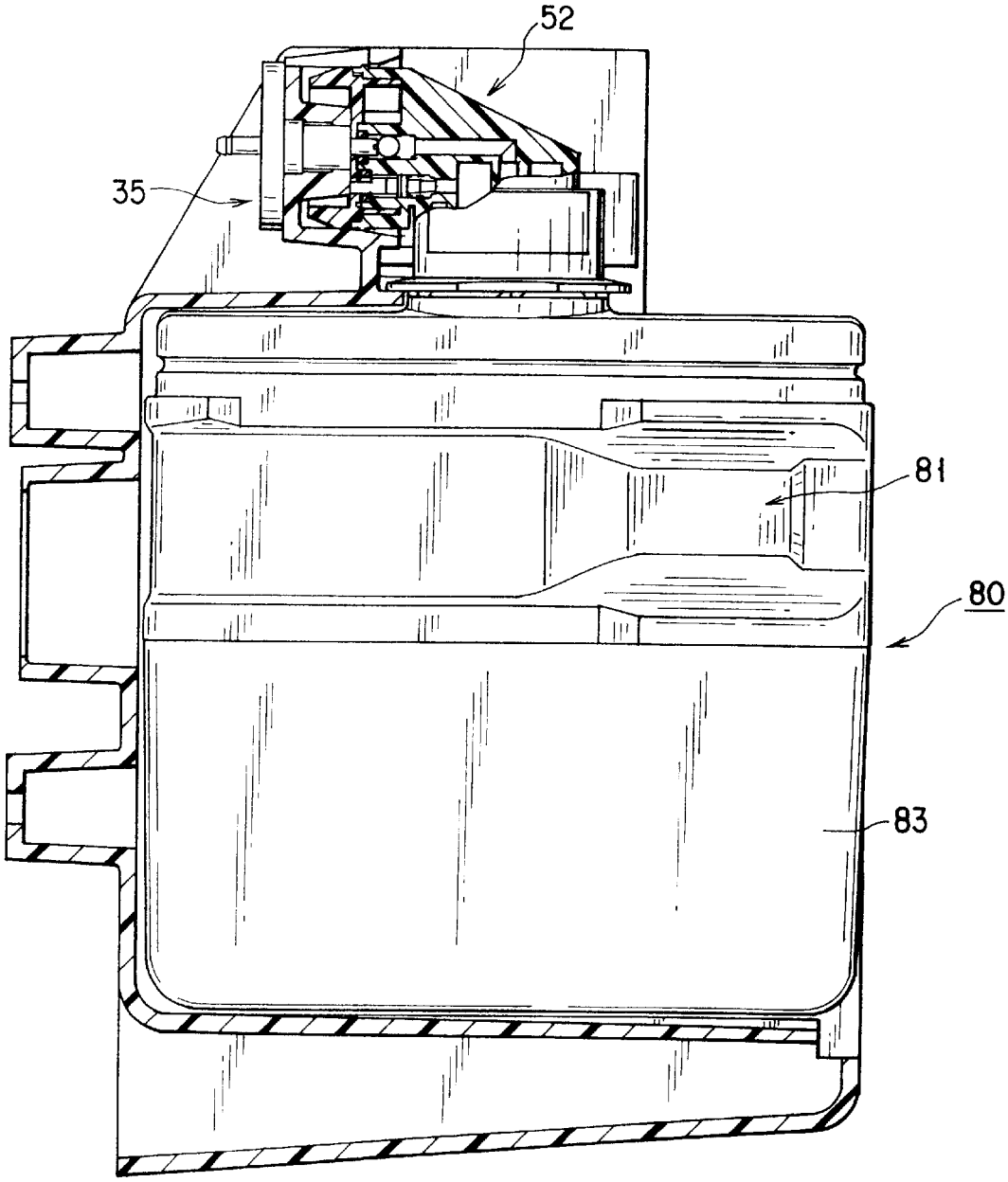
FIG. 7 is a partially cutaway side view showing that the assembly shown in FIG. 6 is attached to the holder of the recording apparatus.

An operation of attaching the 250 ml type of ink bottle constituted as described above to the holder of the recording apparatus will next be described with reference to FIGS. 6 and 7.

First, the cap 83 is removed from above the bottle main body 81, and attached to a lower part of the bottle main body. For this, the cap 83 is reversed 180° so that the open end of the cap turns upwards, and the bottle main body is inserted into the cap from a bottom surface side. Immediately after the bottle main body is inserted in the cap, the engagement protrusion 88 of the cap engages with the lower engagement groove 85 of the bottle main body. As shown in FIG. 6, the cap and bottle main body are integrally fixed to each other. In this case, the distance L1 between the engagement protrusion or detent 88 and the lower end surface of the cap is equal to the distance L2 between the lower engagement groove 85 of the bottle main body 81 and the abutment surface of the lower stopper 87*a* or 87*b* as described above.

During engagement, the lower end of the cap (upper end in FIG. 5C) also abuts on the abutment surface of the lower stopper 87*a* or 87*b*. The cap and bottle main body are integrally connected to each other by the engagement and abutment. On the other hand, when the distance L1 is slightly shorter than the distance L2, the bottle main body is connected to the cap only by the engagement of the engagement protrusion 88 of the cap and the lower engagement groove 85 of the bottle main body. In this case, if the connection is not achieved later for some reason, and the bottle main body is deeply inserted in the cap, the lower end of the cap abuts on the abutment surface of the lower stoppers 87*a*, 87*b*, and the bottle main body is connected to the cap.

In this connected state of the bottle main body and cap, the distance between the joint portion 52 and the lower engagement groove 85 (or the abutment surface of the lower stoppers 87*a*, 87*b*), and the distance between the upper surface of the cap and the engagement protrusion 88 (or the lower end of the cap) are set so that the distance between the upper surface (lower surface in FIG. 6) of the upper wall of the cap 83 and the joint portion 52, that is, the height of the joint portion from the bottom surface of the cap is the same as the distance between the bottom surface of the bottle main body of the standard type of ink bottle (FIGS. 3A to 3D) and the joint portion 52, that is, the height of the joint portion from the bottom surface of the bottle main body.

As a result, the 250 ml ink bottle 80 with the cap 83 attached to the lower part thereof has substantially the same width and length as those of the standard type ink bottle 50. Similarly, the height is also the same. Therefore, similarly as the standard type ink bottle, the 250 ml ink bottle can also be attached to the holder of the recording apparatus as shown in FIG. 7, while the joint portions 35, 52 are satisfactorily connected to each other.

Figure 8:
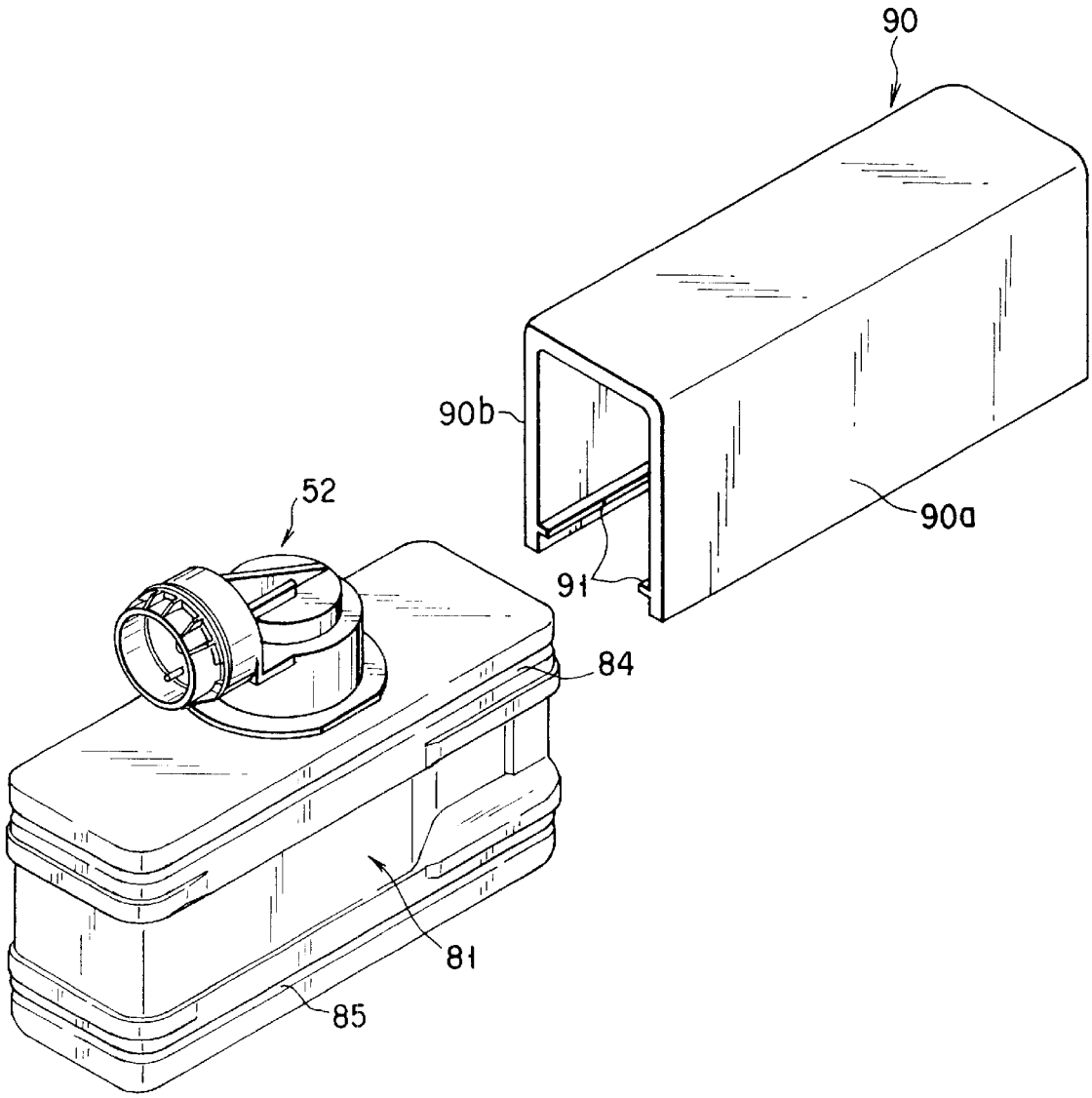
FIG. 8 is a perspective view of an ink bottle of a second type according to a second embodiment of the present invention.

The 250 ml type ink bottle according to a second embodiment will next be described with reference to FIG. 8.

In the second embodiment, since the ink bottle is the same as the ink bottle shown in FIG. 5C except a cap 90, description of an overlapping part will be omitted. The cap 90 has an inverse U-shaped section, and not only a lower end of the cap but also at least one of a front end and a back end of the cap are open (both the front and back ends are open in this embodiment). The height, width, and length of the cap are set to be substantially the same as those of the cap of the first embodiment. Engagement protrusions or guide rails 91 project from inner surfaces of opposite side walls 90*a*, 90*b* of the cap, and are disposed opposite to each other in the vicinity of the lower end of the cap, further extend over the whole longitudinal direction. A position in which the protrusion 91 is formed is the same as a position in which the engagement protrusion 88 of the cap of the first embodiment is formed. Therefore, as shown in FIG. 8, the opening of the cap is directed downwards, the engagement protrusion 91 is fitted into the upper engagement groove 84, the cap 90 is slid in the longitudinal direction with respect to the main body 81, and the cap is attached to the main body. The joint portion 52 can thus be covered with and protected by the cap. On the other hand, the opening of the cap is directed upwards, the engagement protrusion 91 is fitted into the lower engagement groove 85, the cap 90 is slid in the longitudinal direction with respect to the main body 81, and the cap 90 is attached to the main body 81. Thereby, the height of the ink bottle is set to be the same as the height of the standard type ink bottle. Therefore, it would be understood that similarly as the ink bottle of the first embodiment, the ink bottle of the second embodiment can satisfactorily be attached to the holder of the recording apparatus.

In the above description, the first ink bottle has a capacity of 500 ml, and the second ink bottle has a capacity of 250 ml, but the capacities are only examples, and the capacity can arbitrarily be selected. Moreover, the ink bottle whose capacity is ½ of the capacity of the first ink bottle has been described as the second ink bottle, but these ink bottles are not set to this relation, and the ink bottle having an arbitrary capacity can be used. In this case, it would be understood that the height of the cap, and the positions of the engagement groove, engagement protrusion, and stopper may be set in accordance with a capacity ratio of the bottle main bodies of ink bottles of both types.

In the aforementioned embodiments, the engagement protrusion is formed in the cap, and the engagement groove is formed in the bottle main body. However, even when the engagement protrusion is formed in the cap, and the engagement protrusion is formed in the bottle main body, substantially the similar effect is obtained. Moreover, means for fixing the cap to the bottle main body is not limited to the groove/protrusion means, and may be any other means such as various snap connectors.

In the aforementioned embodiments, the cap also serves as auxiliary means for setting the height of the small-capacity ink bottle to be substantially the same as the height of the large-capacity ink bottle, but this is not limited, and an arbitrary spacer such as another ink bottle may be used in combination with the bottle main body.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A second ink bottle detachably attached to a bottle holder of an ink jet printer, and set to be lower than a first ink bottle comprising an outflow port connected to an inflow port of the bottle holder when the first ink bottle is attached to the bottle holder, said second ink bottle comprising:

(a) a bottle main body which has a bottom surface and an upper surface and in which ink is contained;

(b) a joint portion which is disposed on an upper portion of the bottle main body and which has an outflow port connectable to the inflow port of said bottle holder; and (c) a spacer which is detachably attached to a lower side of said bottle main body and which has a bottom surface, wherein a height of the outflow port of the second ink bottle with respect to the bottom surface of the spacer is the same as a height of the outflow port of the first ink bottle with respect to the bottom surface of the first ink bottle, when the spacer is attached to the bottle main body.

2. The second ink bottle according to claim 1, wherein said spacer comprises a cap which has an opening and which is detachably attached to the upper portion of the bottle main body so as to cover said joint portion from an opening side.

3. The second ink bottle according to claim 2, further comprising at least one groove/protrusion assembly for attaching said cap to the bottle main body.

4. The second ink bottle according to claim 3, wherein said groove/protrusion assembly comprises a pair of engagement protrusions which are formed in an inner surface of said cap in the vicinity of the opening and disposed opposite to each other, and a main engagement grooves which are formed in the vicinity of the bottom surface of an outer peripheral surface of the bottle main body, to be respectively engaged with said engagement protrusions.

5. The second ink bottle according to claim 4, wherein said groove/protrusion assembly comprises sub engagement grooves which are formed in the vicinity of the upper surface of the outer peripheral surface of said bottle main body to be respectively engaged with said respective engagement protrusions of the cap.

6. The second ink bottle according to claim 5, wherein said bottle main body comprises at least one stopper projecting between said main engagement groove and the sub engagement groove in the outer peripheral surface of said bottle main body, and abutting on an edge defining the opening of said cap to inhibit the cap from further moving to an attaching direction, when the engagement protrusion engages with one of the main engagement groove and the sub engagement groove or when engagement failure occurs.

7. The second ink bottle according to claim 2 wherein said bottle is formed of polyethylene teraphthalate, and said cap is formed of polypropylene.

8. An ink bottle in which ink for use in an ink jet printer is contained, comprising:

(a) a bottle main body in which ink is contained;

(b) a bottle joint portion disposed on an upper portion of the bottle main body and attachably/detachably connected to a joint portion having an ink path of the ink jet printer;

(c) a cap having one end defining an opening, and detachably attached to the upper portion of the bottle main body so as to cover said bottle joint portion from an opening side; and (d) an attaching mechanism for detachably attaching said cap removed from the upper portion of said bottle main body to a lower portion of the bottle main body.

9. The ink bottle according to claim 8, wherein said attaching mechanism comprises at least one pair of detents formed in an inner peripheral surface of said cap in the vicinity of the opening of the cap, and a groove which is formed in a lower outer peripheral surface of said bottle and in which the respective detents of said cap can be inserted.

10. The ink bottle according to claim 9, wherein said bottle comprises a stopper formed in the outer peripheral surface of the bottle and positioned above the groove of the bottle, the stopper abutting on one end of the cap with the detents of the cap inserted in the groove of the bottle, thereby preventing the cap from shifting upwards with respect to the bottle.

11. An ink bottle in which ink for use in an ink jet printer is contained, comprising:

(a) a bottle main body which has an upper wall, a lower wall, and at least one pair of side walls disposed opposite to each other, in which ink is contained, and which further has an upper groove and a lower groove formed in the vicinity of an outer upper surface and an outer lower surface of said side wall, respectively;

(b) a bottle joint portion which is disposed on the upper wall of the bottle main body and which has an ejection port connectable to an ink path of the ink jet printer; and (c) a cap having one end defining an opening, and having a detent projecting from an inner peripheral surface of the cap in the vicinity of said one end of the cap so that the detent can selectively be inserted in said upper groove and the lower groove and the cap is selectively attached to an upper portion and a lower portion of the bottle main body.

12. The ink bottle according to claim 11, wherein said cap is attached to the upper portion of the ink bottle when the ink bottle is transported and stored, and attached to the lower portion of the ink bottle when the ink bottle is used in the ink jet printer.

13. An ink bottle attached to a bottle holder of an ink jet printer comprising a joint portion having an ink inflow port, a first guide disposed behind the joint portion, and a second guide disposed behind the first guide, said ink bottle comprising:

(a) a bottle main body in which ink is contained;

(b) a joint portion disposed in an upper portion of the bottle main body, detachably/attachably connected to the joint portion of said bottle holder, and having an ink outflow port connected to said ink inflow port when the joint portion of the ink bottle is connected to the joint portion of the bottle holder; and (c) a spacer which is attached to the lower portion of the bottle main body, and which has a lower end surface, wherein the lower end surface of the spacer slides along said second guide and the ink bottle is guided and inserted in an insertion initial stage of said ink bottle into the bottle holder, and the joint portion of said ink bottle slides along said first guide and the ink bottle is guided and inserted immediately before the ink bottle is completely attached to the bottle holder.

14. The ink bottle according to claim 13, wherein said spacer comprises a cap which is attached to the upper portion of the bottle main body during transport or storage of the ink bottle.

15. The ink bottle according to claim 13, wherein the joint portion of said ink bottle slides along said first guide, so that the ink bottle is positioned in the bottle holder in a height direction, and connected to the joint portion of said bottle holder.

16. A combination of a first ink bottle selectively detachably attached to a bottle holder of an ink jet printer and a second ink bottle having a capacity smaller than a capacity of the first ink bottle, said first ink bottle comprising:

(a) a first bottle main body which has a bottom surface, and in which ink is contained; and (b) a first joint portion disposed on an upper portion of the first bottle main body and detachably attached to the bottle holder so that ink in the first bottle main body is supplied to said bottle holder, said second ink bottle comprising:

(c) a second bottle main body which is lower than said first ink bottle, and in which ink is contained;

(d) a second joint portion disposed on an upper portion of the second bottle main body and detachably attached to said bottle holder so that ink in the second bottle main body is supplied to said bottle holder; and (e) a spacer which has a bottom surface, and which is detachably attached to a lower portion of said second bottle main body, and (f) wherein a distance between the bottom surface of the spacer and the second joint portion is the same as a distance between the bottom surface of said first bottle main body and the first joint portion, when the spacer is attached to the second bottle main body.

17. The combination according to claim 16, further comprising at least one groove/protrusion assembly, disposed between the second bottle main body and the spacer, for attaching the second bottle main body to the spacer so that the distance between the bottom surface of the spacer and the second joint portion is the same as the distance between the bottom surface of said first bottle main body and the first joint portion during attachment of the spacer to the second bottle main body.

18. An ink bottle attached to a bottle holder of an ink jet printer comprising a joint portion in which an insertion pin constituting an ink inflow port and a press surface pressing an air intake are formed, the ink bottle comprising:

(a) a bottle main body in which ink is contained;

(b) an ink bottle side joint portion disposed on an upper portion of the bottle main body and attachably/detachably connected to said bottle holder side joint portion;

(c) an ink outflow port disposed in said ink bottle side joint portion; and (d) an atmospheric open valve disposed on said ink bottle side joint portion, wherein upon insertion of said ink bottle into the bottle holder, the insertion pin of said bottle holder is inserted into said ink outflow port to realize ink supply, and said press surface presses said atmospheric open valve and connects the inside of the ink bottle to the atmosphere.

* * * * *